9/20/83 OR 4,405,482

252/99

United States Patent [19]

Hayes et al.

[11] 4,405,482

[45] Sep. 20, 1983

[54] SANITIZING FORMULATION

[75] Inventors: Russell A. Hayes, Castle Hill, Australia; Gerard Duve, Slough, England

[73] Assignee: Richardson-Vicks Pty. Limited, New South Wales, Australia

[21] Appl. No.: 297,919

[22] Filed: Aug. 31, 1981

[30] Foreign Application Priority Data

Sep. 1, 1980 [AU] Australia ..... PE5356

[51] Int. Cl.[3] ..... C11D 7/56

[52] U.S. Cl. ..... 252/99; 252/135; 252/526; 252/527

[58] Field of Search ..... 252/99, 135, 526, 527

[56] References Cited

U.S. PATENT DOCUMENTS

| | | | |
|---|---|---|---|
| 3,850,831 | 11/1974 | Hellsten et al. | 252/99 |
| 4,120,811 | 10/1978 | Yagi et al. | 252/99 |
| 4,126,573 | 11/1978 | Johnston | 252/99 |
| 4,131,562 | 12/1978 | Lutz et al. | 252/99 |
| 4,152,283 | 5/1979 | Cordrey et al. | 252/99 |
| 4,208,295 | 6/1980 | Sai et al. | 252/99 |
| 4,326,976 | 4/1982 | Logan et al. | 252/99 |

*Primary Examiner*—Norman Morgenstern
*Assistant Examiner*—Janyce A. Bell
*Attorney, Agent, or Firm*—George W. Rauchfuss, Jr.

[57] ABSTRACT

An improved sanitizing formulation contains a peroxy hydrate compound, a non-phosphate water softener, a source of magnesium ion as a partial hydrogen peroxide stabilizer, a chelating agent for transition metals and a nonionic surfactant.

6 Claims, 2 Drawing Figures

S/A

SANITIZING FORMULATION

BACKGROUND OF THE INVENTION

1. Field of the Invention

Figure 1:
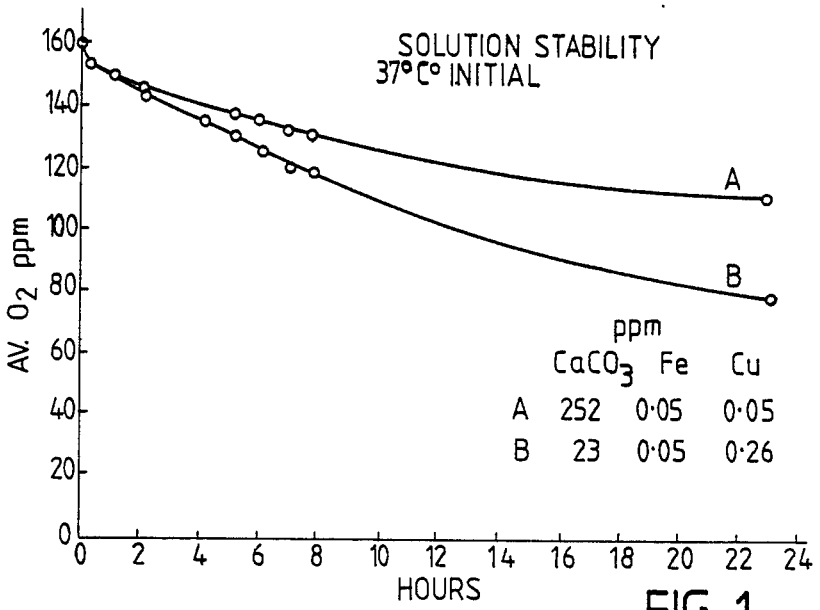

This invention relates to an improved sanitizing formulation. Sanitizing formulations currently in use are designed particularly for use in the treatment of baby's napkins and the present formulation has been developed particularly for use in this area. However, the formulation of the invention is not restricted to the treatment of baby's napkins and may also be used for a variety of sanitizing, bleaching, cleansing, deodorizing, stain removing and/or purposes in other domestic or institutional laundries. Accordingly, although for convenience, the following description will refer primarily to the use of the formulations in conjunction with the treatment of baby's napkins, it is to be understood that the invention is not limited to this application.

2. Description of the Prior Art

It is desirable that products used for napkin treatment will both kill the bacteria present on the wet or soiled napkin and will also remove such stains as may be present on the napkin. It is further desirable that the treatment solution in which the napkins being treated are soaked will remain microbiologically active and bleach active for an extended period to cope with random additions of wet and soiled napkins.

Many current napkin treatment formulations rely on the formation of hypochlorous acid in solution and hence on the bleaching and antimicrobial effect of this acid. However, the action of chlorine releasing formulations is susceptible to significant deterioration by the presence of the organic matter in the treatment solution, provided by wet and soiled napkins. Furthermore, the bleaching action of such formulations is undesirable for applications other than napkin treatment where colour fastness becomes an important consideration. The use of peroxy hydrate compounds which, in solution, release hydrogen peroxide as an oxidizing agent have also been proposed for use in napkin treatment formulations. In the latter formulations however, the stability of the released hydrogen peroxide in solution and the consequent ability of the soak solution to retain its activity for the required extended period has hitherto been a problem for which no fully satisfactory solution has been found.

Numerous bleaching compositions containing peroxy hydrate compounds have been proposed, such as those discussed in U.S. Pat. Nos. 3,956,156, 3,960,743, 4,003,700 and 4,064,062, which require some form of activator for the peroxy hydrate compound. These specifications also disclose the desirability of further additives to reduce the amount of activator required in such compositions. U.S. Pat. Nos. 3,606,990 and 4,231,890 disclose the use of further materials to this type of composition to inhibit decomposition of the peroxy hydrate compound.

SUMMARY OF THE INVENTION

The present invention now provides a formulation which can be used to produce a solution having improved stability together with improved stain removal, bleaching and antimicrobial activity. The formulations of the present invention use 5 to 95% by weight of a peroxy hydrate compound which in solution releases hydrogen peroxide, the oxidizing action of which provides the required antimicrobial, stain removing and bleaching activity for the formulation. The preferred peroxy hydrate compound used in the invention is sodium percarbonate.

The formulations of the invention will commonly be prepared for sale containing a substantial proportion of one of more bulking agents. Such formulations use 5 to 40 percent by weight of peroxy hydrate compounds. Alternatively, the composition of the invention may be formulated as a concentrate containing up to 95 percent by weight of peroxy hydrate compound.

In addition to the peroxy hydrate oxidizing agent, the formulation of the invention includes 2 to 25% by weight of a non-phosphate water softener. It has been found that the use of typically applied amounts of sodium tripolyphosphate and other similar phosphate softeners often used in prior formulations of this type substantially reduces the long term activity of solutions of the peroxy hydrate compound. Accordingly, the sodium tripolyphosphate or similar detergent builder used in prior compositions is replaced in the compositions of the present invention with a non-phosphate water softener, preferably one containing the citrate ion. For example, hydrous sodium citrate is one preferred non-phosphate water softener used in the present formulations.

It has been found further that the hydrogen peroxide produced by the peroxy hydrate compound of the present formulations is partially stabilized in solution by the presence of approximately 30 parts per million of magnesium ion. Accordingly, in order that the present formulation may be used in water which does not naturally provide sufficient magnesium ion, the formulation of the invention includes 0.1 to 5% by weight of a source of magnesium ion, for example, magnesium sulfate, which acts to partially stabilize the hydrogen peroxide and also hardens the water in the solution in which the formulation is used.

It has also been found that the hydrogen peroxide produced by the peroxy hydrate compound in the formulation of the present invention is quite rapidly decomposed by trace amounts of transition metals such as iron and copper often found in normal water supplies. Accordingly, the formulation of the invention includes 0.01 to 5% by weight of a chelating agent for such transition metals which is not itself decomposed by the oxidative action of hydrogen peroxide. For example, diethylenetriaminepentaacetic acid is a suitable chelating agent.

The use of the preferred sodium percarbonate as the peroxy hydrate compound in the formulations of the invention and the possible use of additional carbonate ion containing compounds as other ingredients later described, provides a substantial carbonate ion content in the formulation. Accordingly, when such formulations are used in hard water containing calcium ion, the formation of a calcium carbonate scale on the napkins being treated and on the vessel in which the treatment is conducted, can present a substantial problem. It has been found however that this problem can be alleviated by the addition of sodium polymetaphosphate to the formulation which acts to inhibit calcium carbonate scale formation. When used in the formulations of the present invention sodium polymetaphosphate is present in an amount within the range of 0 to 5 percent, depending on the amounts of additional carbonate ion containing compounds and non-phosphate water softener present and the degree of hardness in the water used for the preparation of the in-use solution.

As a further means of combating problems arising from the formulation of calcium carbonate scale, the formulations of the present invention also include 0.1 to 8% by weight of a non-ionic surfactant, for example nonyl phenol ethoxylate. The presence of a non-ionic surfactant not only prevents the adherance of any calcium carbonate scale which may be formed but also assists in binding together the relatively large granules in which some of the components of the formulation are normally available and thus reduces the tendency for the particles in the formulation to segregate upon vibration of the packaged formulation.

In additon to providing sanitizing, stain removal and bleaching effects on the napkins being treated, napkin treatment formulations preferably also provide a cleansing effect on the treated napkins. Accordingly, the formulations of the present invention preferably further include a cleansing agent. One cleansing agent which has been found particularly suitable is sodium carbonate. The presence of a substantial quantity of sodium carbonate in the formulations of the present invention need not lead to adverse effects in hard water due to the presence in the composition of the calcium carbonate scale countering components referred to above. Thus, a cleansing agent such as sodium carbonate may be present in the formulations of the invention in substantial amounts, for example from 20 to 50% by weight, depending on the desired balance between the cleansing and other activities of the formulation concerned.

The formulations of the present invention may further include bulking agents in accordance with known practice in the formulation of detergents and similar materials. A suitable bulking agent for use in solid formulations of the present invention is sodium chloride. For liquid formulations a suitable bulking agent is water.

In order to assist the various activities of the formulations of the invention, an anionic detergent may also be included in the formulation. One anionic detergent which has been found suitable for use in the preferred formulations of the invention is sodium alkylbenzene sulphonate.

The performance and consumer acceptability of the products of the invention may be further enhanced by the inclusion of auxiliary agents such as optical brightening agents and perfumes.

The foregoing description has primarily related to formulations prepared and sold as a solid mixture of the required ingredients. Accordingly, all the percentages given in this specification, unless otherwise indicated, are given on a weight/weight basis. The formulation may be prepared using a conventional ribbon blender or similar dry powder blending equipment which provides a degree of shear. It will be appreciated however that the compositions of the invention can also be formulated for sale and use as liquids.

The following example of a preferred composition in accordance with the invention is given to further illustrate the formulations described above. It is to be understood that this example is given by way of illustration only and is not to be construed as limiting.

| Ingredient | % w/w | Nature |
|---|---|---|
| Sodium percarbonate | 25.00 | Oxidizing agent |
| Sodium citrate hydrous | 10.50 | Water softening agent |

-continued

| Ingredient | % w/w | Nature |
|---|---|---|
| Sodium carbonate | 8.00 | Cleansing agent |
| Sodium alkyl benzene sulphonate | 7.00 | Anionic detergent |
| Nonyl phenol ethoxylate | 1.50 | Nonionic detergent |
| Sodium polymetaphosphate | 0.20 | Antiscale agent |
| Magnesium sulphate dried | 1.20 | Water hardening agent |
| Diethylenetriaminepenta-acetic acid | 0.30 | Chelating agent |
| Tinopal CBS | 0.10 | Optical brightener |
| Pine perfume | 0.10 | Perfuming agent |
| Sodium chloride | 46.10 | Bulking agent |
| | 100.0 | |

In preparing the formulation from the above ingredients, the sodium chloride is placed in a blender and while mixing, the liquid ingredients pine perfume and nonyl phenol ethoxylate are poured slowly into the blender. When the mix is uniformly wet, the remaining ingredients are added in the following order while mixing is continued: sodium carbonate, diethylene triamine pentaacetic acid, optical brightening agent, magnesium sulphate dried, sodium polymetaphosphate, sodium citrate hydrous, sodium alkyl benzene sulphonate and sodium percarbonate. The mix is blended until a uniform white cohesive powder is obtained. The preparation is then packaged into moisture resistant containers.

The preferred formulation as described in the foregoing example has been found to provide in use solutions which remain active for over 24 hours and provide long term antimicrobial and stain removal capabilities which are not significantly affected by variable water supply quality, nor the urine and soil associated with baby's napkins. The formulation concerned has been tested as described below:

A. LONG-TERM SOLUTION STABILITY

Test solutions containing 31.5 grams of formulation in 7 liters of water were prepared at 37° held for 24 hours at an ambient temperature of 25°±1° C. The available oxygen content remaining in the solutions was measured periodically and the results obtained are shown in the attached FIGS. 1 and 2.

Figure 2:
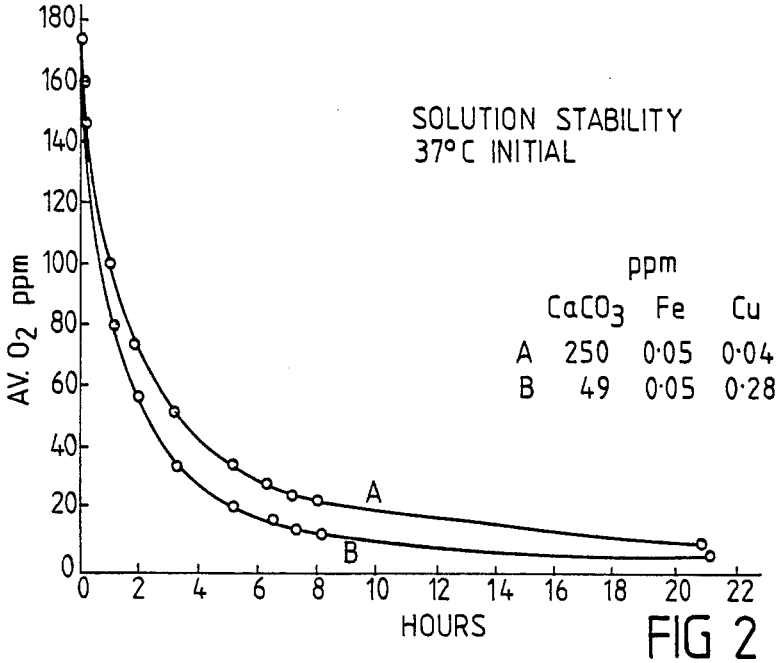

FIG. 1 shows a graphical representation of the results obtained using the formulation of the example above in both hard and soft tap water. By way of comparison, FIG. 2 shows the lack of long term stability of a similar formulation to that of the above example in hard (A) and soft (B) water. The formulation used to obtain the data illustrated in FIG. 2 omits the stabilizing ingredients sodium polymetaphosphate, diethylenetriaminepentaacetic acid, magnesium sulphate dried as well as sodium citrate and nonyl phenol ethoxylate, and part of the bulking agent sodium chloride, from the formulation of the preceding example but contains instead 22.5% of sodium tripolyphosphate.

B. ANTIMICROBIAL CAPACITY

The formulation of the example provides significant antimicrobial capacity when tested under simulated use conditions as defined in the Standards Association of Australia (SAA) Australian Standard 2351-1980 Nappy Sanitizers. The Standard specifies that the number of surviving organisms in the Start and End challenge regimens (Beakers 1 A, B at time 7 hrs and Beakers 2 A, B at time 7 hrs respectively) for both organisms be less than $5\times10^2$ organisms per ml. As seen from the results tabulated below, the formulation in all cases provides satisfactory results. Similar results are obtained when the tests are run at 90% the recommended concentration. A specific neutralizer was used to inactivate the test solutions as required by the Standard method. Dosage: 31.5 g/7 liters.

lated below, the formulation in question provided less overall color change than the alternate treatments in all cases.

These results are confirmed by unaided visual preference ratings obtained by a panel of 20 female respondents.

| | Time | Total Plate Count orgs/ml | | | | | |
|---|---|---|---|---|---|---|---|
| | | *S. aureus* | *E. coli* | *S. aureau* | *E. coli* | *S. aureus* | *E. coli* |
| Beaker | | | | | | | |
| 1 A | 3 | <10 | <10 | $1 \times 10^1$ | <10 | $2 \times 10^1$ | <10 |
| B | | <10 | $1 \times 10^1$ | $3.5 \times 10^1$ | <10 | <10 | <10 |
| 1 A | 7 | <10 | <10 | $1 \times 10^1$ | <10 | <10 | <10 |
| B | | <10 | <10 | $2 \times 10^1$ | <10 | <10 | <10 |
| 2 A | 3 | <10 | <10 | $1 \times 10^1$ | <10 | $2 \times 10^1$ | <10 |
| B | | <10 | <10 | <10 | <10 | $2 \times 10^1$ | <10 |
| 2 A | 7 | $2.3 \times 10^2$ | <10 | $2 \times 10^1$ | <10 | $2.5 \times 10^1$ | <10 |
| B | | $2.5 \times 10^2$ | <10 | <10 | <10 | $4 \times 10^1$ | <10 |
| Controls | | | | | | | |
| 3 A | 0 | $9.2 \times 10^7$ | $5.5 \times 10^7$ | $1.2 \times 10^8$ | $6.9 \times 10^7$ | $7.1 \times 10^7$ | $9.3 \times 10^7$ |
| B | | $8.9 \times 10^2$ | $6.2 \times 10^7$ | $1.1 \times 10^8$ | $6.9 \times 10^7$ | $8.7 \times 10^7$ | $7.4 \times 10^7$ |
| 3 A | 7 | $3.6 \times 10^7$ | $8.0 \times 10^6$ | $1.4 \times 10^7$ | $1.7 \times 10^7$ | $1.1 \times 10^7$ | $1.8 \times 10^7$ |
| B | | $4.8 \times 10^7$ | $7.8 \times 10^6$ | $4.9 \times 10^6$ | $2.0 \times 10^7$ | $1.8 \times 10^7$ | $1.5 \times 10^7$ |

C. STAIN REMOVAL CAPACITY

The stain removal capacity is judged by immersion of a cotton napkin square which has been highly stained with tea solution, in an in-use solution for 16 hours. Prior to the addition of the tea-stained square, an appropriate volume of S.A.A. Simulated Urine is placed in the in-use solution at 1½ hourly intervals for 6 hours. This simulates the rigorous domestic circumstance where a nappy treatment product is required to remain bleach-active after numerous additions of urine-soiled nappies. The following results compare the CIE Lab Color Difference, ΔE, provided by the formulation of the above example with two major brands of napkin treatment products presently on the market. ΔE represents the change in color intensity of the tea-stained napkins due to the treatments. High values denote high degrees of stain removal. ΔE max represents the maximum value of ΔE achievable under the test regimen and denotes the color difference between the untreated tea-stained napkin and the whiteness of an unstained napkin.

| | Example | Brand 1: | Brand 2: |
|---|---|---|---|
| ΔE | 20.8 | 11.5 | 9.1 |
| ΔE max. | 26.2 | 26.2 | 26.2 |
| % stain Removal | 79.4 | 43.9 | 34.7 |

D. TREATMENT EFFECTS ON COLORFAST COTTON GARMENTS

The treatment effects of continued use of the formulation concerned and alternate products presently marketed, is judged by soaking colorfast cotton garments of standardized color in an in-use solution for 20 hours each day for a total of 20 days. The following results compare the CIE lab color difference, ΔE, obtained by formulation of the above example with a major brand of napkin treatment product and a major brand of heavy duty laundry detergent which, in the latter case, was employed in a domestic washing machine operating with a 65° C. water wash cycle each day for the 20 day period. High values denote high degrees of overall color change. E max represents the E value associated with total color removal. As seen from the results tabu-

| Garment Color | Example | Brand 1 | Detergent Wash 1 |
|---|---|---|---|
| Dark Blue | | | |
| ΔE | 1.3 | 10.4 | 3.6 |
| ΔE Max | 70.0 | 70.0 | 70.0 |
| Light Blue | | | |
| ΔE | 7.8 | 10.8 | 8.7 |
| ΔE Max | 26.0 | 26.0 | 26.0 |
| Red | | | |
| ΔE | 3.4 | 6.5 | 4.2 |
| ΔE Max | 79.7 | 79.7 | 79.7 |
| Yellow | | | |
| ΔE | 4.8 | 5.1 | 8.9 |
| ΔE Max | 58.5 | 58.5 | 58.5 |

E. BROAD ANTIMICROBIAL SPECTRUM

As disclosed in "Disinfection, Sterilization and Preservation" by S. S. Block, 2nd Edition, pp 667–681, hydrogen peroxide based disinfectants such as the formulation of the present invention can be expected to have broad antimicrobial capacity encompassing bacteria generally, viruses, fungi and bacteria spores.

F. SANITIZATION AND CLEANING OF THE BODY EXUDATES

In view of the success with which the formulation of the invention has sanitized and removed faecal material and stains from baby's napkins, the use of the formulation in the sanitization and cleaning of linen and clothing contaminated with pus, blood, mucus and vaginal discharge is indicated.

G. DOMESTIC/COMMERCIAL LAUNDRY APPLICATION

Some studies have been performed which indicate the use of the formulation of the invention to treat domestic and commercial garments generally by way of domestic/commercial laundry appliances using both hot and cold water, thereby providing superior stain removal, deodorization, cleansing and sanitizing properties compared to present laundry preparations. In order to optimize this usage of the preferred composition in accordance with the invention, further ingredients may be added to, or present ingredients may be omitted from, the formulations above. Such further ingredients include, for example, sodium sulphate, sodium carboxymethylcellulose, sodium metasilicate, sodium tripolyphosphate and sodium stearate.

It will be appreciated from the foregoing that formulations can be prepared in accordance with the present invention to cover in use situations which vary widely as to the nature of the materials treated by the formulation and in relation to the type of water in which the formulation of the invention is dissolved. The invention makes possible the production of a formulation which provides stain removing, cleansing, deodorization and antimicrobial capacity by a combination of interacting ingredients giving desirable long-term activity. Formulations in accordance with the present invention can be adjusted in accordance with the quality of the water used for the preparation of the in-use solution.

We claim:

1. A sanitizing and bleaching composition comprising by weight percent the following:

(a) from 5 to 95% of a peroxy hydrate compound;
(b) from 2 to 25% of a non-phosphate water softener containing the citrate ion;
(c) from 0.1 to 5% of a source of magnesium ion as a partial hydrogen peroxide stabilizer;
(d) from 0.01 to 5% of a chelating agent for transition metals;
(e) from 0 to 5% of sodium polymetaphosphate; and
(f) from 0.1 to 8% of a nonionic surfactant.

2. A composition of claim 1 containing 5 to 40% by weight of peroxy hydrate compound and 0.01 to 5% by weight sodium polymetaphosphate.

3. A composition of claim 2 wherein the peroxy hydrate compound is sodium percarbonate; the water softener compound is hydrous sodium citrate; the magnesium ion compound is magnesium sulphate; the chelating agent is diethylenetriaminepentaacetic acid; and the nonionic surfactant is nonly phenol ethoxylate.

4. A composition of claim 3 further containing one or more of a cleansing agent, a bulking agent, an anionic detergent, an optical brightener and a perfume.

5. A composiion of claim 4 wherein there is present sodium carbonate as cleansing agent; sodium chloride as bulking agent; and sodium alkylbenzene sulphonate as anionic detergent.

6. A sanitizing and bleaching composition comprising by weight percent the following:

(a) about 25% sodium percarbonate;
(b) about 10.5% hydrous sodium citrate;
(c) about 1.2% dried magnesium sulphate;
(d) about 0.3% diethylenetriaminepentaacetic acid;
(e) about 0.2% sodium polymetaphosphate;
(f) about 1.5% nonyl phenol ethoxylate;
(g) about 8% sodium carbonate;
(h) about 46% sodium chloride;
(i) about 7% sodium alkyl benzene sulphonate; and
(j) about 0.1% each of an optical brightener and a perfuming agent.

* * * * *